United States Patent [19]

Neeser et al.

[11] Patent Number: 4,947,651

[45] Date of Patent: Aug. 14, 1990

[54] PRESSURE BUILDING CIRCUIT FOR A CONTAINER FOR LOW TEMPERATURE FLUIDS

[75] Inventors: Timothy Neeser, Savage; Duane Preston; Michael Lutgen, both of New Prague, all of Minn.

[73] Assignee: Minnesota Valley Engineering, Inc., New Prague, Minn.

[21] Appl. No.: 335,192

[22] Filed: Apr. 7, 1989

[51] Int. Cl.[5] ..... F17C 9/04

[52] U.S. Cl. ..... 62/50.4; 62/303; 62/475

[58] Field of Search ..... 62/50.4, 50.2, 48.1, 62/303, 475, 85

[56] References Cited

U.S. PATENT DOCUMENTS

| | | | |
|---|---|---|---|
| 2,964,919 | 12/1960 | Howlett | 62/50.4 |
| 3,174,294 | 3/1965 | Lawrence | 62/50.4 |
| 3,195,317 | 7/1965 | Mientus | 62/50.4 |
| 3,232,066 | 2/1966 | Peterson et al. | 62/50.4 |
| 3,707,078 | 12/1972 | Cramer | 62/50.4 |
| 4,018,582 | 4/1977 | Hinds et al. | 62/50.4 |

*Primary Examiner*—Ronald C. Capossela
*Attorney, Agent, or Firm*—Rockey and Rifkin

[57] ABSTRACT

A pressure building circuit for a double-walled tank containing a low temperature fluid, including a settling ring and an orifice between the tank outlet and the pressure building coil for maintaining a minimum pressure.

9 Claims, 2 Drawing Sheets

PRESSURE BUILDING CIRCUIT FOR A CONTAINER FOR LOW TEMPERATURE FLUIDS

BACKGROUND OF THE INVENTION

The use of pressure building coils interposed between the walls of a double-walled cryogenic tank is well known in the art. Such coils are conventionally placed such that low temperature fluid passes from the tank directly into the coil. The coil is in contact with the outer wall of the tank, and heat transferred there vaporizes the gas. Pressure building coils are conventionally in the form of tubes which are helically disposed around the interior of the outer wall of a double-walled tank.

Pressure building coils of the type described above are used to maintain gas pressure in the tank head as gas is withdrawn. Conventionally, the pressure building coil feeds directly into the top of the tank through a regulator which permits gas from the pressure building coil to be added to the tank when the head pressure above the liquid level in the tank falls below a set value.

Conventional systems, however, are deficient in several respects. First, as the low temperature fluid is withdrawn through the bottom of the tank, impurities which may be settled in or near the bottom of the tank are also withdrawn. These impurities may be deleterious to the proper function of the pressure building coil, the gas use line, or may be otherwise unsuitable for passage through the pressure building coil and into said gas use line. Use of the presure bulding coil may be disrupted as a result of the presence of these impurities. Thus, it is desirable to provide a means by which these impurities may be removed from the low temperature fluid prior to entry into the pressure building coil.

The conventional system described above also has the problem of pressure head collapse when demand for gas from the tank becomes too great. Thus, if gas is withdrawn from the tank at a high rate, the pressure head may be lowered to an unacceptable value. The pressure building coil is unable to compensate for this pressure drop, since the rate of pressure increase through the pressure building coil is typically less than the rate of pressure loss resulting from withdrawal of gas through the gas use line. It is therefore desirable to provide a system in which the pressure in the gas use line may be increased during periods of high demand, the pressure increase being derived directly from the pressure building coil.

SUMMARY OF THE INVENTION

The present invention is a pressure building circuit for a double-walled cryogenic tank. The circuit includes an inlet for admitting low temperature fluid into a settling ring, and an outlet from the settling ring communicating with a pressure building coil. The pressure building coil is interposed between the walls of the tank and is contact with the outer wall thereof. The coil gassifies a low temperature fluid, such as liquid carbon dioxide, and supplies it to the top of the tank to maintain head pressure. A restricted orifice is disposed in the path to the tank top to maintain a desirable pressure gradient between said tank and said pressure building coil. A gas use line is also connected to said pressure building inlet. Thus, when necessary, gas may be diverted from the pressure building coil to the use line to maintain pressure therein.

It is an object of the present invention to provide such a pressure building circuit to maintain a minimum pressure in the gas use line during periods of peak use of gas from the tank.

It is a further object of the invention to provide a settling ring to capture impurities in the low temperature fluid which are otherwise unsuitable for passage through the pressure building coil or the gas use line.

Yet another object of the invention is to provide a settling ring such that the operation of the pressure building circuit continues even when significant amounts of impurities are present.

These and other objects of the present invention will become apparent from the detailed description of the invention set forth hereafter.

DETAILED DESCRIPTION OF THE INVENTION AND PREFERRED EMBODIMENT

Figure 1:
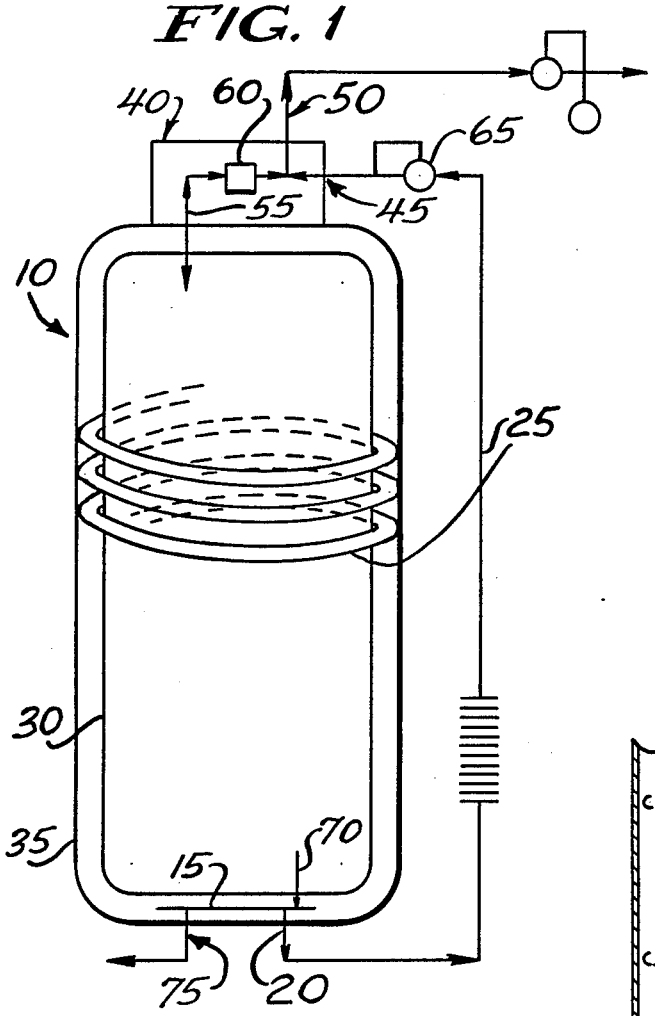
FIG. 1 is a simplified schematic diagram of the pressure building circuit of the present invention.
Figure 2:
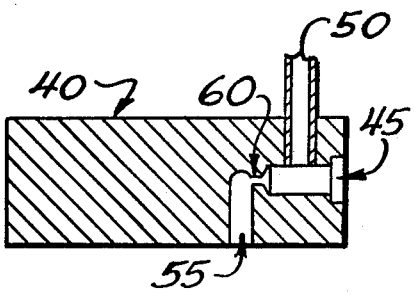
FIG. 2 is a simplified sectional view of a knuckle showing the restricted orifice according to the present invention.

Referring to FIG. 1, tank 10 is a double-walled tank of the type commonly used to contain low temperature fluids such as liquid carbon dioxide. Tank 10 has disposed between inner wall 30 and outer wall 35 a settling ring 15 which has an inlet 70 from the bottom of the tank and an outlet 20. Outlet 20 connects to a pressure building coil 25 helically dispose around tank 10 between inner wall 30 and outer wall 35. Low temperature fluid from tank 10 passes into and through settling ring 15 and outlet 20 to the pressure building coil 25. Pressure building coil 25 is interposed between the inner wall 30 of tank 10 and the outer wall 35 of tank 10, such that the pressure building coil 25 is in contact with outer wall 35. The contact between pressure building coil 25 and outer wall 35 permits heat transfer to the coil to vaporize the low temperature fluid therein. Pressure building coil 25 to an inlet 45 (shown in FIG. 2).

Inlet 45 is formed in a knuckle 40 disposed atop the tank, and connects the pressure building coil 25 to gas use line 50 and the top of the tank. Gas use line 50 opens from inlet 45, and may be connected to any apparatus requiring a source of gas. Inlet 45 also communicates with the tank via opening 55. It is through this opening that gas in the head above the liquid is withdrawn and supplied through gas use line 50. Opening 55 communicates with inlet 45 and gas use line 50 via an orifice 60, which is substantially reduced in size than opening 55 and pressure building inlet 45.

In the preferred embodiment, pressure building coil 25 includes a regulator 65, shown in FIG. 1. Regulator 65 is set to close when the tank head pressure reaches a specified value. For example, regulator 65 may be set so that it closed when the head pressure in tank 10 is equal to or greater than 140 psi, and open when the pressure is less than 140 psi. The effect of opening the regulator is to supply pressure to both gas use line 50 and the tank head. Because of orifice 60, pressure is maintained at an acceptable value in gas use line 50 during periods of high demand. During periods of normal demand, sufficient gas from pressure building coil 25 passes through inlet 45 and opening 55 to maintain or restore head pressure.

The size of orifice 60 is determined based on the minimum pressure desired in gas use line 50. Thus, the orifice must be small enough to limit a pressure drop in gas use line 50 during periods of high demand when the head pressure in tank 10 is low, by diverting most of the gas from pressure building coil 25 to gas use line 50. At the same time, orifice 60 must be large enough to permit a sufficient flow of gas from tank 10 through opening 55 to gas use line 50 when the head pressure in tank 10 is high and regulator 65 is closed. The size of orifice 60 may be determined empirically based on the desired pressures in the use line and the type of low temperature fluid employed.

The effect of orifice 60 may be illustrated by the following four Examples, in which $P_1$ is the head pressure in tank 10, and the set point of regulator 65 is 140 psi.

EXAMPLE 1

Demand for gas is low, such that $P_1$ is greater than or equal to 140 psi. Regulator 65 is therefore closed, and gas is supplied from tank 10 to gas use line 50 through orifice 60.

EXAMPLE 2

Demand for gas is high, such that $P_1$ is less than 140 psi. Regulator 65 is therefore open, and gas from pressure building coil 25 is supplied through inlet 45 to gas use line 50, as well as from tank 10. Orifice 60 functions in this instance to limit the pressure drop in gas use line 50.

EXAMPLE 3

Demand for gas is high, but $P_1$ remains above 140 psi. (This situation may occur, for example, at the beginning of a period of high demand.) Regulator 65 is therefore closed. Orifice 60 must be sufficiently large to meet the demand. If $P_1$ drops below 140 psi, operation reverts to that described in Example 2.

EXAMPLE 4

Demand for gas is low, but $P_1$ is less than 140 psi. (This situation may occur, for example, immediately following a period of high demand). Regulator 65 is therefore open. Since gas is not needed for gas use line 50, gas from pressure building coil 25 passes through orifice 60 and opening 55 into tank 10, where the pressure head in tank 10 is quickly restored to 140 psi. After restoration of the pressure head in tank 10, regulator 65 is closed, and the operation set forth in Example 1 is applicable.

In the foregoing four Examples, the minimum acceptable pressure in the gas use line was assumed to be 90 psi. The size of tank 10 was 160 liters, and the quanity of low temperature fluid (for instance, carbon dioxide) inside tank 10 was 400 pounds. The diameter of orifice 60 was 0.042 inches, while the diameters of opening 55 and inlet 45 were 0.250 inches and 0.562 inches, respectively. These diameters were sufficient to achieve the conditions of Examples 1–4, above.

Figure 5:
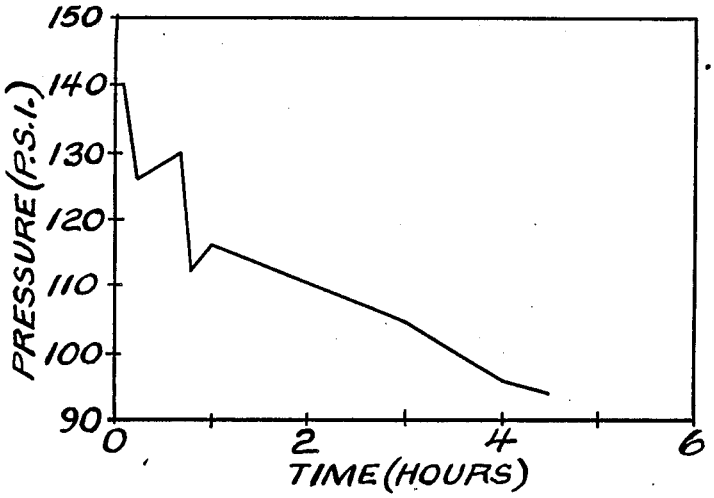
FIG. 5 is a graph showing the rate of pressure drop in a gas use line in a system employing a conventional pressure building coil.
Figure 6:
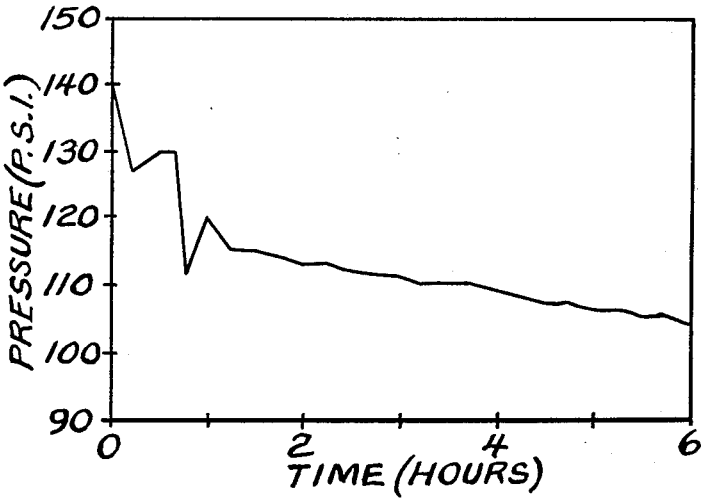
FIG. 6 is a graph showing the rate of pressure drop in a gas use line in a system employing a pressure building circuit according to the present invention.

The stabilization of pressure as a result of the use of orifice 60 is illustrated in FIGS. 5 and 6. These graphs were made by operating identical systems acting under the following conditions: in the first hour of testing gas flow was maintained at a rate of 5.72 lbs/hour except for two transfers in which 5 lbs were withdrawn in eight minutes; for the second through sixth hours of testing, a flow rate of 11.44 lbs/hour was maintained. FIG. 5 shows a the drop in pressure over time in the gas use line of a system employing a conventional pressure building coil, tending to decrease to a value less than the minimum acceptable pressure in the gas use line. FIG. 6 conversely, shows the drop in pressure over time in the gas use line of a system employing the pressure building coil of the present invention, including an orifice having a diameter of 0.042 inches, tending toward a stable pressure significantly higher than the minimum acceptable pressure in the gas use line.

Figure 3:
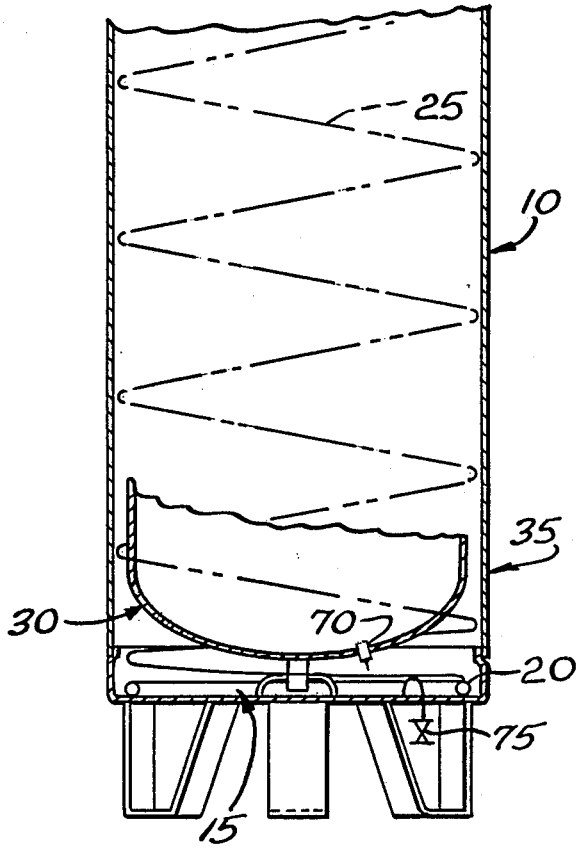
FIG. 3 is a simplified sectional view of a double-walled tank in which the settling ring according to the present invention is shown.
Figure 4:
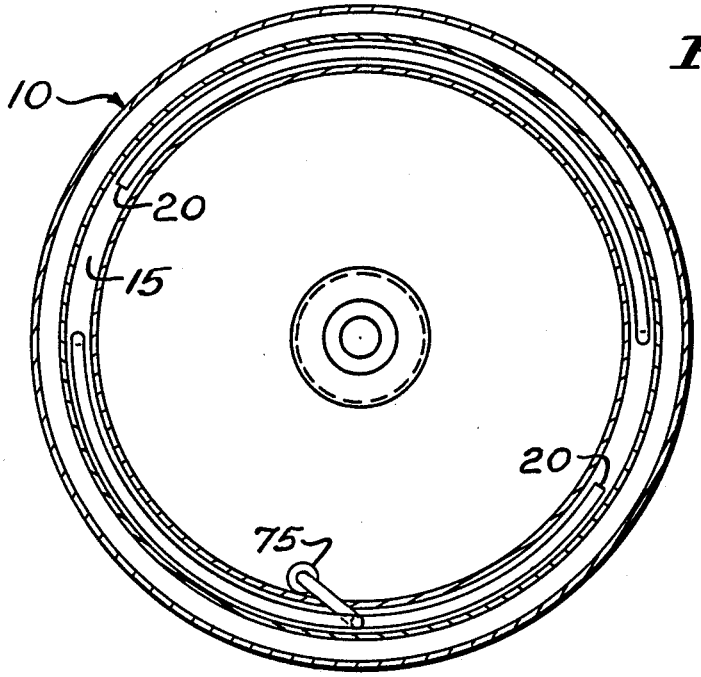
FIG. 4 is a simplified top view of the settling ring according to the present invention.

Referring to FIG. 3, settling ring 15 is disposed between inner wall 30 and outer wall 35 of tank 10, in contact with outer wall 35. Settling ring 15 is connected to the bottom of tank 10 by means of inlet 70, and is connected to pressure building coil 25 via outlet 20. Low temperature fluid in tank 10 passes through inlet 70 into settling ring 15, where impurities in the low temperature fluid settle out. Such impurities include, for example, ice crystals which form when moisture is introduced during filling of the tank. The failure to remove such impurities may result in blockage of the pressure building coil and disablement of the tank. The low temperature fluid then passes through outlet 20 into pressure building coil 25, where it is vaporized and employed as described above.

Settling ring 15 is also provided with a drain 75 through which waste containing impurities which have settled out may be readily removed. It is preferred that settling ring 15 be circular for pressure containment, with inlet 70 and outlet 20 diametrically opposite one another, to increase the area through which the low temperature fluid passes and settling occurs. Settling ring 15 is preferably disposed substantially horizontally to permit impurities contained in the low temperature fluid to settle out. Settling ring 15 is also preferably disposed at the lowest point of the pressure building circuit for maximum removal of impurities through settling.

Settling ring 15 also increases the efficiency of the pressure building circuit. Settling ring 15 is preferably significantly larger in diameter than pressure building coil 25, and is in contact with outer wall 35. This size and placement will permit substantial amounts of impurities, such as ice or water, to settle in the ring without disruption of the operation of the pressure building coil. The placement of settling ring 15 in contact with outer wall 35 will further permit any ice in the settling ring to easily melt for drainage through drain 75.

A dropped portion of pressure building coil 25, fitted with a drain 75, may also function as a settling ring.

The present invention has been described with respect to certain embodiments and conditions, which are not meant to and should not be construed to limit the invention. Those skilled in the art will understand that variations from the embodiments and conditions described herein may be made without departing from the invention as claimed in the appended claims.

What is claimed is:

1. A pressure building circuit for a double-walled tank containing a low pressure fluid, said tank having an opening at the upper portion thereof to supply gas therefrom to a use line, said circuit comprising:

a pressure building coil communicating the lower portion of said tank with said upper portion opening and said use line, said coil disposed between the walls of said tank in contact with the outer wall thereof to vaporize said low temperature fluid by heat transfer to maintain pressure in the vapor portion of said tank; and, an orifice of reduced diameter interposed between said pressure building coil and said upper portion opening to establish a pressure gradient therebetween, thereby to divert a selected quantity of gas from said coil directly to said use line during periods of high demand, whereby the pressure building coil will normally supply gas to the upper portion of the tank to maintain gas pressure therein but will assit in supplying gas to said use line during high demand periods.

2. The pressure building circuit of claim 1, wherein said pressure building coil includes regulator means to shut off the gas flow in the coil when pressure in an upper portion of said tank is at least a selected minimum value.

3. The pressure building circuit of claim 1, wherein said pressure building circuit includes a settling ring comprising an inlet from said tank to a settling ring, said settling ring placed at the bottom of said tank, and an outlet from said ring connected to the pressure building coil.

4. The pressure building circuit of claim 3, wherein said settling ring further includes means for removing waste from said settling ring.

5. The pressure building circuit of claim 4, wherein said means for removing waste from said settling ring comprises a drain.

6. A settling ring for a double-walled tank containing a low temperature fluid including a pressure building coil, comprising an inlet from said tank to said settling ring, said settling ring, being of tubular cross section and disposed between said tank walls at the bottom thereof; an outlet from an upper portion of said ring connected to a pressure building coil; said ring being substantially horizontally disposed to permit impurities contained in the low temperature fluid to settle out.

7. The settling ring of claim 6, wherein said ring further comprises means for removing waste from said settling ring.

8. The settling ring of claim 7, wherein said means for removing waste from said settling ring comprises a drain.

9. A pressure building circuit for a double-walled tank containing a low temperature fluid, said tank having an opening at the upper portion thereof to supply gas therefrom to a use line, said circuit comprising:

a pressure building coil communicating the lower portion of said tank with said upper portion opening and said use line, said coil disposed between the walls of said tank in contact with the outer wall thereof to vaporize said low temperature fluid by heat transfer to maintain pressure in the upper portion of said tank, said pressure building coil including regulator means to shut off the gas flow in the coil when pressure in an upper portion of said tank is at least a selected minimum value;

a settling ring comprising an inlet from said tank to a settling ring, said settling ring placed at the bottom of said tank, and an outlet from said ring connected to the pressure building coil, and, an orifice of reduced diameter interposed between said pressure building coil and said upper portion opening to establish a pressure gradient therebetween, thereby to divert a selected quantity of gas from said coil directly to said use line during periods of high demand, whereby the pressure building coil will normally supply gas to the upper portion of the tank to maintain gas pressure therein but will assist in supplying gas to said use line during high demand periods.

* * * * *